US009080473B2

(12) United States Patent
Wigsten

(10) Patent No.: US 9,080,473 B2
(45) Date of Patent: Jul. 14, 2015

(54) CAM TORQUE ACTUATED—TORSIONAL ASSIST PHASER

(75) Inventor: Mark Wigsten, Lansing, NY (US)

(73) Assignee: BorgWarner, Inc., Auburn Hills, MI (US)

( * ) Notice: Subject to any disclaimer, the term of this patent is extended or adjusted under 35 U.S.C. 154(b) by 145 days.

(21) Appl. No.: 13/880,770

(22) PCT Filed: Oct. 28, 2011

(86) PCT No.: PCT/US2011/058305

§ 371 (c)(1), (2), (4) Date: Apr. 22, 2013

(87) PCT Pub. No.: WO2012/061234

PCT Pub. Date: May 10, 2012

(65) Prior Publication Data

US 2013/0206088 A1 Aug. 15, 2013

Related U.S. Application Data

(60) Provisional application No. 61/409,352, filed on Nov. 2, 2010.

(51) Int. Cl.
*F01L 1/34* (2006.01)
*F01L 1/344* (2006.01)

(52) U.S. Cl.
CPC ..... *F01L 1/3442* (2013.01)

(58) Field of Classification Search
CPC ..... F01L 1/3442; F01L 1/344
USPC ..... 123/90.15, 90.17, 90.31
See application file for complete search history.

(56) References Cited

U.S. PATENT DOCUMENTS

| | | | |
|---|---|---|---|
| 5,207,192 | A | 5/1993 | Smith |
| 6,453,859 | B1 | 9/2002 | Smith et al. |
| 6,883,481 | B2 | 4/2005 | Gardner et al. |
| 7,137,371 | B2 | 11/2006 | Simpson et al. |
| 8,356,583 | B2 | 1/2013 | Smith |
| 2003/0033999 | A1 | 2/2003 | Gardner |
| 2004/0211379 | A1 | 10/2004 | Palesch |

*Primary Examiner* — Zelalem Eshete
(74) *Attorney, Agent, or Firm* — Helmholdt Law PLC; Thomas D. Helmholdt

(57) ABSTRACT

A variable cam timing phaser for an internal combustion engine includes a housing (10) and a rotor (20) connected coaxially with respect to a camshaft for rotation relative to one another. The housing (10) and the rotor (20) can define at least one cavity (10*a*) with a vane (22) dividing each cavity (10*a*) into a first chamber (16) and a second chamber (18). A control valve (24) can have a longitudinally reciprocal spool (36). The spool (36) can move between an advance timing position and a retard timing position within a Cam Torque Actuated mode of operation, an advance timing position within a Torsional Assist mode of operation, and at least one null position. The spool (36) can connect the first chamber (16), the second chamber (18), a check valve (40) and an actuating fluid supply source (46) with respect to one another, and can connect a passage (62) associated with a lock pin (60) between an exhaust vent (48*a*, 48*b*) and the actuating fluid supply source (46).

15 Claims, 3 Drawing Sheets

CAM TORQUE ACTUATED—TORSIONAL ASSIST PHASER

FIELD OF THE INVENTION

The present invention relates to a mechanism intermediate a crankshaft and a poppet-type intake or exhaust valve of an internal combustion engine for operating at least one such valve, wherein means are provided to vary a time period relative to an operating cycle of the engine, and further wherein means are provided to vary a structure or an axial disposition of a camshaft or an associated cam of the camshaft.

BACKGROUND

The performance of an internal combustion engine can be improved by the use of dual camshafts, one to operate the intake valves of the various cylinders of the engine and the other to operate the exhaust valves. Typically, one camshaft is driven by the crankshaft of the engine, through a sprocket and chain drive or a belt drive, and the other camshaft is driven by the first, through a second sprocket and chain drive or a second belt drive. Alternatively, both of the camshafts can be driven by a single crankshaft powered chain drive or belt drive. A crankshaft can take power from the pistons to drive at least one transmission and at least one camshaft. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

As is conventional in the art, there can be one or more camshafts per engine. A camshaft can be driven by a belt, or a chain, or one or more gears, or another camshaft. One or more lobes can exist on a camshaft to push on one or more valves. A multiple camshaft engine typically has one camshaft for exhaust valves, one camshaft for intake valves. A "V" type engine usually has two camshafts (one for each bank) or four camshafts (intake and exhaust for each bank).

Variable camshaft timing (VCT) devices are generally known in the art, such as U.S. Pat. Nos. 5,002,023; 5,107,804; 5,172,659; 5,184,578; 5,289,805; 5,361,735; 5,497,738; 5,657,725; 6,247,434; 6,250,265; 6,263,846; 6,311,655; 6,374,787; and 6,477,999. A dual mode phaser that switches between Cam Torque Actuated (CTA) mode of operation and Torsional Assist (TA) mode of operation with a secondary valve is known in U.S. Pat. No. 6,453,859. A Cam Torque Actuated (CTA) phaser that uses one high pressure chamber check valve is known in U.S. Pat. No. 7,137,371. Each of these prior known patents appears to be suitable for its intended purpose.

SUMMARY

It would be desirable to provide a Cam Torque Actuated (CTA) phaser that can operate in a Torsional Assist (TA) mode of operation depending on spool position to allow the use of a Cam Torque Actuated (CTA) phaser on an engine where a Cam Torque Actuated (CTA) phaser would normally not operate throughout the engine speed range.

A variable cam timing phaser can include a housing and a rotor disposed to rotate relative to each other. The housing and the rotor can define at least one cavity divided by a vane. The vane can divide the cavity into a first chamber and a second chamber. Passages can connect the first chamber, the second chamber, and an actuating fluid supply source with respect to one another facilitating oscillation of the vane within the cavity. A control valve can have a longitudinally reciprocal spool for operably moving between a Cam Torque Actuated (CTA) mode of operation and a Torsional Assist (TA) mode of operation selectively connecting the first chamber, the second chamber, a check valve, and the actuating fluid supply source between one another in different longitudinal positions.

A variable cam timing phaser for an internal combustion engine having at least one camshaft can include a housing and a rotor connected coaxially with respect to a camshaft to define at least one cavity divided by a vane into a first chamber and a second chamber. A control valve can have a longitudinally reciprocal spool for moving between at least one Cam Torque Actuated (CTA) mode of operation, at least one Torsional Assist (TA) mode of operation, and at least one null position. The spool can connect the first chamber, the second chamber, a check valve, and an actuating fluid supply source with respect to one another.

A variable cam timing phaser for an internal combustion engine having at least one camshaft can include a housing and a rotor connected coaxially with respect to a camshaft and disposed to rotate relative to one another. The housing and the rotor can define therebetween at least one cavity and at least one vane located within each cavity dividing each cavity into a first chamber and a second chamber. A lock pin can move between a released position and a locked position to lock the housing and the rotor together independent of actuating fluid flow. A control valve can have a longitudinally reciprocal spring biased spool with an internally located check valve. The spool can operably move between an advance timing position and a retard timing position within a Cam Torque Actuated (CTA) mode of operation, an advance timing position within a Torsional Assist (TA) mode of operation, and at least one null position. The spool can operably connect the first chamber, the second chamber, the check valve, and an actuating fluid supply source with respect to one another, and can operably connect the lock pin between an exhaust vent and the actuating fluid supply source. A valve control unit can have a variable force solenoid for operating the longitudinally reciprocal spool of the control valve in response to an input signal from an engine control unit for movement between the Cam Torque Actuated (CTA) modes of operation, the Torsional Assist (TA) mode of operation, and the at least one null position.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
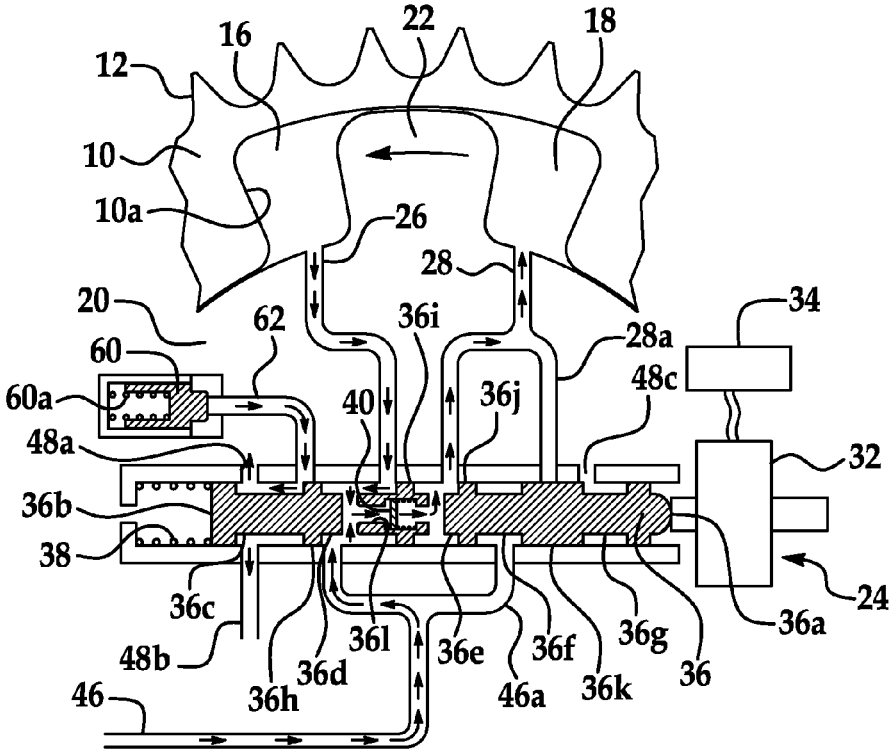
FIG. 1 is a schematic view of a Cam Torque Actuated (CTA)—Torsional Assist (TA) Variable Cam Timing (VCT) phaser with a control valve having a spool actuated by a Valve Control Unit (VCU), such as a Variable Force Solenoid (VFS), in response to an Engine Control Unit (ECU) moving toward a CTA mode of operation retard timing position, where the spool is in a first position corresponding to movement toward a retard timing position and to vent the lock pin actuating fluid supply line for moving the lock pin to the locked position.

Referring now to FIG. 1, a Cam Torque Actuated (CTA)—Torsional Assist (TA) Variable Cam Timing (VCT) phaser can include a housing 10 with sprocket teeth 12 formed with an outer periphery for meshing engagement with a timing chain, or belt, or gear (not shown). Inside the housing 10, at least one cavity 10*a* is formed. Coaxially within the housing 10, and free to rotate relative to the housing 10, is a rotor 20 with a vane 22 fit within each corresponding cavity 10*a* to define a first fluid chamber 16 and a second fluid chamber 18. A control valve 24 can route pressurized actuating fluid or oil via passages 26, 28 between the first and second chambers 16, 18 respectively to drive the vane 22 of the rotor 20 in response to cam torque actuation forces. It will be recognized by one skilled in the art that this description is common to vane phasers in general, and the specific arrangement of vanes, chambers, passages and valves shown in FIGS. 1-5 can be varied within the teachings of the invention. For example, the number of vanes and their location can be changed, some phasers have only a single vane, others can have as many as a dozen, and the vanes-might be located on the housing and reciprocate within chambers on the rotor. The housing might be driven by a chain or belt or gears, and the sprocket teeth might be gear teeth or a toothed pulley for a belt.

Figure 4:
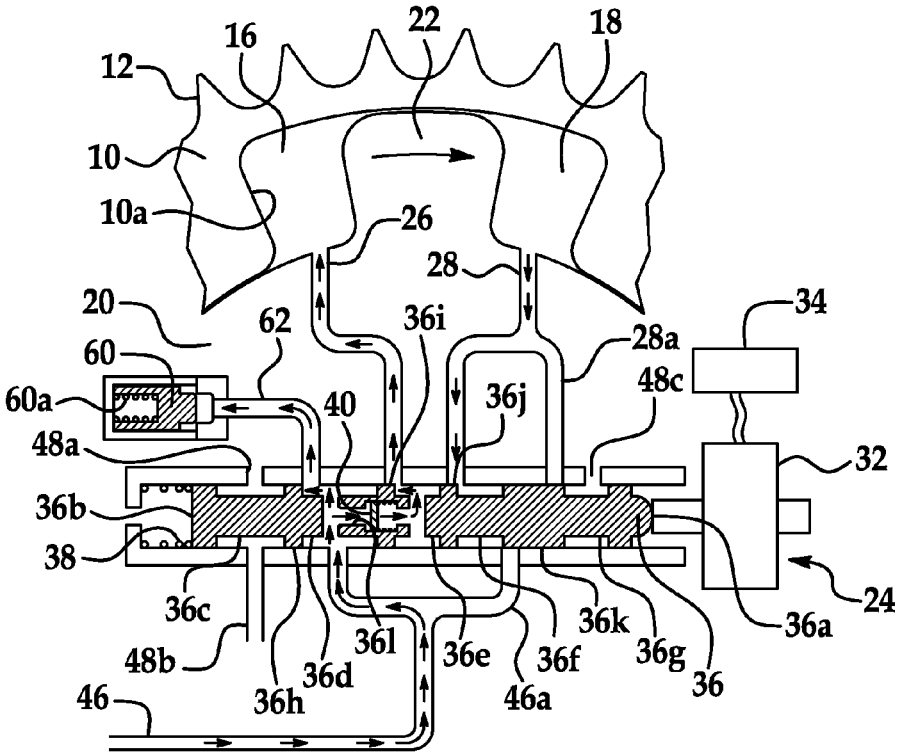
FIG. 4 is a schematic view a Cam Torque Actuated (CTA)—Torsional Assist (TA) Variable Cam Timing (VCT) phaser with a control valve having a spool actuated by a Valve Control Unit (VCU), such as a Variable Force Solenoid (VFS), in response to an Engine Control Unit (ECU) moving toward a modal null timing position between CTA mode of operation and TA mode of operation, where the spool is in a fourth position corresponding to movement toward a modal null timing position and to move the lock pin with pressurized actuating fluid from a supply line to the release position.
Figure 5:
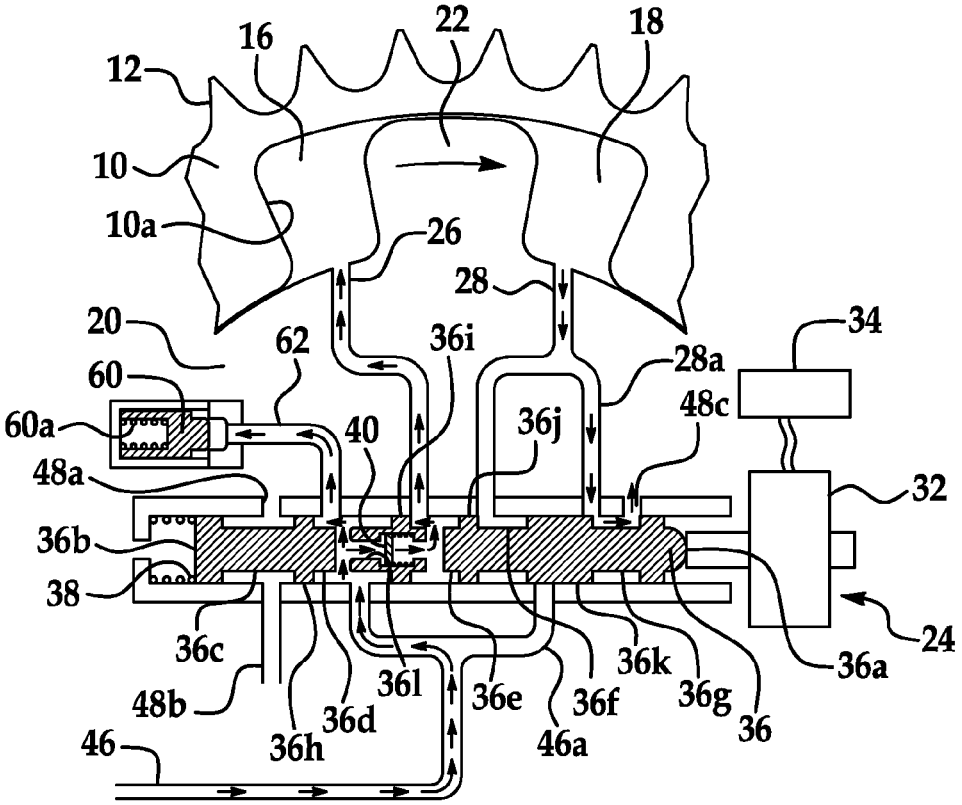
FIG. 5 is a schematic view a Cam Torque Actuated (CTA)—Torsional Assist (TA) Variable Cam Timing (VCT) phaser with a control valve having a spool actuated by a Valve Control Unit (VCU), such as a Variable Force Solenoid (VFS), in response to an Engine Control Unit (ECU) moving toward a TA mode of operation advance timing position, where the spool is in a fifth position corresponding to movement toward an advance timing position and to move the lock pin with pressurized actuating fluid from a supply line to the release position.

The control valve 24 can have a spool 36 actuated by a Valve Control Unit (VCU) 32, such as a Variable Force Solenoid (VFS), in response to an input signal from an Engine Control Unit (ECU) 34, using eitheropen loop or closed loop control sequences, to position the control valve 24, by way of example and not limitation, such as a spool-type control valve 24 as shown for completing a set of fluid circuits. By engaging the spool-type control valve 24 via a force exerted on a first end 36*a* of the spool 36 of the control valve 24, an equilibrium position can be achieved by an equal force exerted on a second end 36*b* of the spool 36 of the control valve 24 by means of an elastic member 38, such as a spring. The spool 36 defines a plurality of reduced diameter chambers 36*c*, 36*d*, 36*e*, 36*f*, 36*g* separated by larger diameter lands 36*h*, 36*i*, 36*j*, 36*k*. A central passage 36*l* within the spool 36 connects chambers 36*d*, 36*e* through an internally located spring biased check valve 40. The spool 36 is moveable between a first position adjacent a first end limit of travel (fully extended as schematically shown in FIG. 1), a second position (shifted inward to the left as schematically shown in FIG. 2), a third position (shifted further inward to the left as schematically shown in FIG. 3), a fourth position (shifted even further inward to the left as schematically shown in FIG. 4), and a fifth position adjacent a second end limit of travel (as schematically shown in FIG. 5).

Still referring to FIG. 1, when in the first position, fluid passage 26 is in fluid communication with chamber 36*d* of the spool. Fluid passage 28 is in fluid communication with chamber 36*e* and further is in fluid communication with chamber 36*d* through internal spool passage 36*l*. The fluid circuit can include a check valve 40, which can be an internal check valve as illustrated or an external check valve. A source of pressurized actuating fluid or oil is supplied through actuating fluid supply source passage 46 to chambers 36*e*, 36*f* of the spool 36 to make up for any fluid losses. An optional lock passage 62 can be provided in fluid communication between chamber 36*c* at one end and a lock pin 60 at an opposite end. An exhaust vent or exhaust passage 48*a*, 48*b* can be placed in fluid communication with chamber 36*c* of the spool 36 allowing the lock passage 62 to be exhausted moving the spring biased lock pin 60 toward the locked position. The VFS of the VCU 32 operates the spool 36 for movement toward a CTA mode of operation, retard timing position. When the spool 36 is in the first position, the optional lock passage 62 associated with the optional lock pin 60 can be connected in fluid communication through the spool 36 to an exhaust vent passage 48*a*, 48*b* for moving the lock pin 60 to the locked position. Cam torque actuation forces drive the vane 22 in rotation by driving actuating fluid from the first chamber 16 through passage 26, chamber 36*d*, internal spool passage 36*l*, check valve 40, chamber 36*e*, passage 28 and into chamber 18, causing chamber 16 to contract while chamber 18 expands. The rotation of vane 22 relative to housing 10 can continue until the optional spring biased lock pin 60 engages within a corresponding aperture in the locked position. When the optional lock pin 60 is in the locked position, the rotor 20 and housing 10 can rotate together as a single assembly independent of actuating fluid flow.

Figure 2:
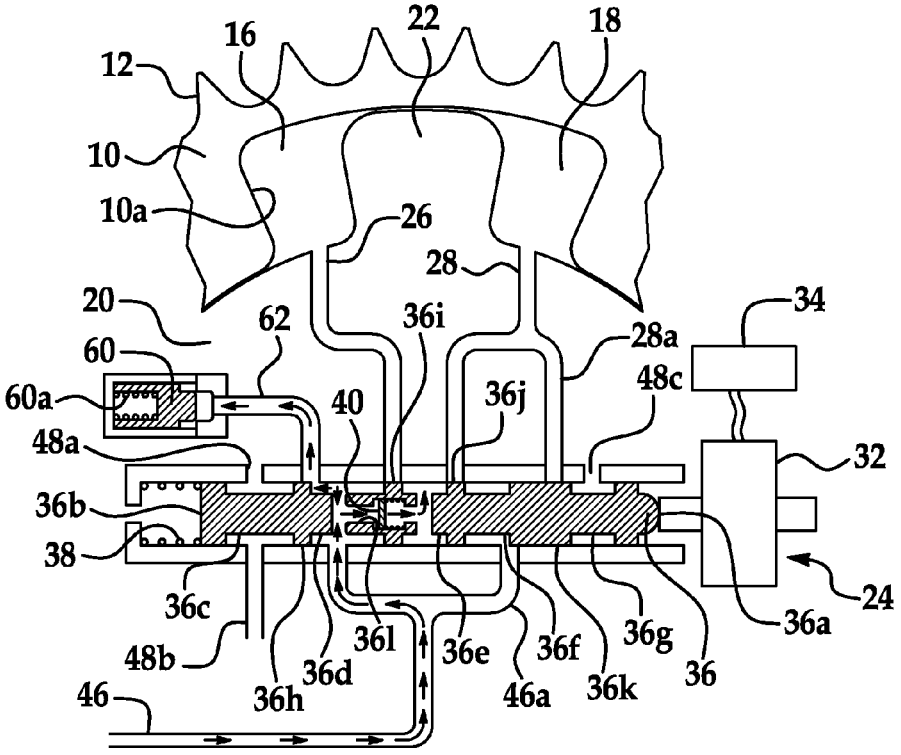
FIG. 2 is a schematic view a Cam Torque Actuated (CTA)—Torsional Assist (TA) Variable Cam Timing (VCT) phaser with a control valve having a spool actuated by a Valve Control Unit (VCU), such as a Variable Force Solenoid (VFS), in response to an Engine Control Unit (ECU) moving toward a CTA mode of operation—CTA null timing position, where the spool is in a second position corresponding to movement toward a CTA null timing position and to move the lock pin with pressurized actuating fluid from a supply line to the release position.

Referring now to FIG. 2, spool 36 is shifted (inwardly and to the left as schematically illustrated) to a second position. In the second position, land 36*i* blocks fluid communication with passage 26 and land 36*j* blocks fluid communication with passage 28. The control valve 24 is moved toward a CTA mode of operation—CTA null timing position, where the optional lock pin 60 is in fluid communication with the actuating fluid supply source passage 46 through chamber 36*d* for moving the lock pin 60 to the release position against the urging of biasing spring 60*a*, while chamber 36*e* is pressurized through chamber 36*d*, internal spool passage 36*l* and check valve 40 to make up for any fluid losses. In other words, the rotor 20 and housing 10 are no longer mechanically interconnected to one another through the optional lock pin 60 being in the locked position, but the fluid chambers 16, 18 are isolated from one another as a result of passages 26, 28 being blocked by lands 36*i*, 36*j* of the spool 36. A fluid coupling exists between the housing 10 and rotor 20 as a result of the actuating fluid trapped within chambers 16, 18 allowing the housing 10 and rotor 20 to rotate with one another in a CTA null timing position in the absence of a mechanical lock. Spool 36 position changes from this CTA null position will cause the phaser to advance or retard in CTA mode of operation. The relative position of the rotor 20 with respect to the housing 10 can be any desired angular orientation as a result of cam torque actuation forces driving the vane 22 within the cavity 10*a* prior to isolating chambers 16, 18 from one another with the spool in the second position. Therefore, it should be understood that this "CTA null position" of the spool 36 can be associated with any desired angular orientation of the rotor 20 with respect to the housing 10.

Figure 3:
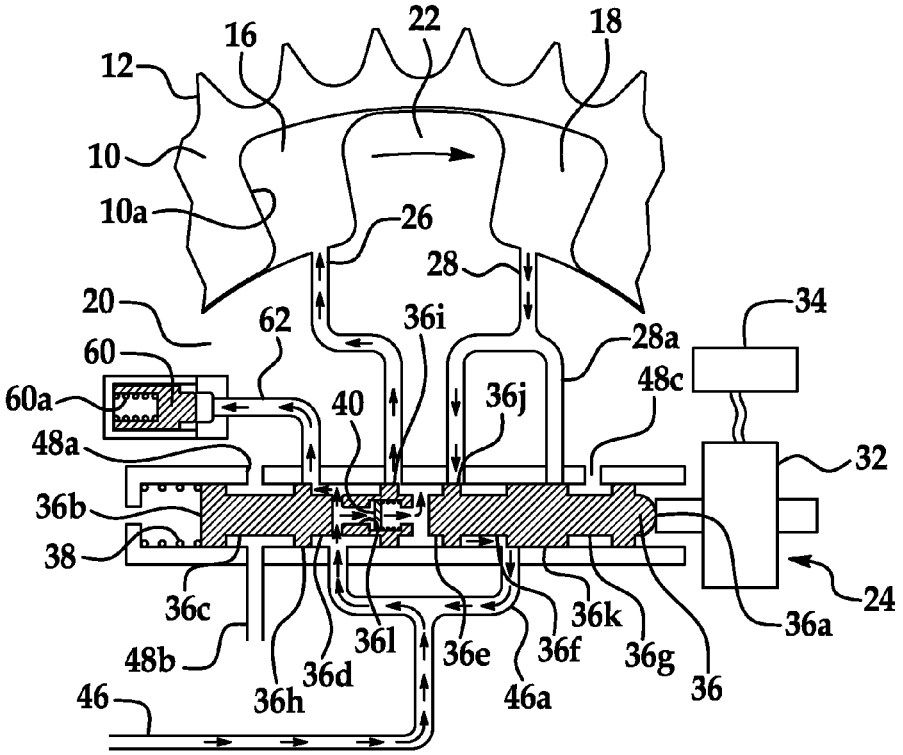
FIG. 3 is a schematic view a Cam Torque Actuated (CTA)—Torsional Assist (TA) Variable Cam Timing (VCT) phaser with a control valve having a spool actuated by a Valve Control Unit (VCU), such as a Variable Force Solenoid (VFS), in response to an Engine Control Unit (ECU) moving toward a CTA mode of operation advance timing position, where the spool is in a third position corresponding to movement toward an advance timing position and to move the lock pin with pressurized actuating fluid from a supply line to the release position.

Referring now to FIG. 3, spool 36 is shifted (further inwardly and to the left as schematically illustrated) to a third position. In the third position, land 36*i* is positioned to place passage 28 in fluid communication through chamber 36*f* with CTA recirculation passage 46*a* allowing fluid communication with chamber 36*d*. The control valve 24 is moved toward a CTA mode of operation advance timing position, where the spool is in a third position to move the rotor relative to the housing to advance timing of the internal combustion engine valve actuation, while maintaining the optional lock pin with pressurized actuating fluid from a supply line in the release position. Chamber 36*d* is in fluid communication with actuating fluid supply source passage 46 to pressurize the optional lock passage 62 to maintain the optional lock pin 60 in a released position. When in the third position, chamber 36*d* is also in fluid communication through internal spool passage 36*l* and check valve 40 with chamber 36*e*. Chamber 36*e* is in fluid communication with passage 26 allowing actuating fluid flow into chamber 16 causing chamber 16 to expand while chamber 18 contracts.

Referring now to FIG. 4, spool 36 is shifted (even further inwardly and to the left as schematically illustrated) to a fourth position. In the fourth position, land 36*k* blocks fluid communication between chamber 36*g* and the actuating fluid supply source passage 46. The control valve 24 has moved toward a modal null timing position between the CTA mode of operation and a TA mode of operation, where the optional lock pin 60 is maintained in the release position with pressurized actuating fluid from the actuating fluid supply source passage 46 through chamber 36*d*. Chamber 36*d* is also in fluid communication with chamber 16 through internal spool passage 36*l*, check valve 40, and passage 26 to make up for any fluid losses. The fourth spool position prevents a direct leak of actuating fluid to exhaust vent 48*c*, since the CTA recirculation passage 46*a* is blocked by land 36*k* just before the exhaust vent 48*c* is placed in fluid communication with chamber 18 though chamber 36*g*. This creates a "modal null position" in the case where cam torsional actuation forces have become inadequate to advance timing of the phaser in CTA mode of operation, by way of example and not limitation, such as high speed on a four cylinder engine. Pushing the spool 36 beyond this point will advance timing of the phaser in TA mode of operation.

Referring now to FIG. 5, spool 36 is shifted (inwardly to the left as schematically illustrated) to a fifth position corresponding to a second end limit of travel. In the fifth position, chamber 36*g* is in fluid communication with exhaust vent 48*c* allowing chamber 18 to vent through branch passage 28*a*. The control valve 24 moves to a TA mode of operation advance timing position, where the optional lock pin 60 is maintained in the released position with pressurized actuating fluid from a supply source passage 46 acting through chamber 36*d* and optional lock passage 62. Chamber 36*d* also is in fluid communication through internal spool passage 36*l*, check valve 40, chamber 36*e*, and passage 26 with chamber 16. The phaser can move to advance timing of the internal combustion engine valve actuation due to a pressure differential acting on the vane 22.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A phaser having a housing (10) and a rotor (20) disposed to rotate relative to each other, the housing (10) and the rotor defining at least one cavity (10*a*) disposed therebetween to be divided by a vane (22) into a first chamber (16) and a second chamber (18), the phaser further having passages (26, 28) connecting the first chamber (16) and the second chamber (18) facilitating oscillation of the vane (22) within the cavity (10*a*), the phaser comprising:

a check valve (40);

a control valve (24) having a spring biased, longitudinally reciprocal spool (36) operably moveable between at least one Cam Torque Actuated (CTA) mode of operation, at least one Torsional Assist (TA) mode of operation, and at least one null position, the spool (36) selectively connecting the first chamber (16), the second chamber (18), the check valve (40), and an actuating fluid supply source (46) between one another in different longitudinal positions; and a valve control unit (32) operating the control valve (24) for movement between the Cam Torque Actuated (CTA) mode of operation, the Torsional Assist (TA) mode of operation, and the at least one null position.

2. The phaser of claim 1 further comprising:

the valve control unit (32) selectively moving the spool (36) of the control valve (24) with respect to a retard timing position in the Cam Torque Actuated (CTA) mode of operation, where the first chamber (16) and the second chamber (18) are in fluid communication with one another through the check valve (40) allowing actuating fluid flow from the first chamber (16) to the second chamber (18) in response to cam torque actuation forces and in fluid communication with the actuating fluid supply source (46) to offset fluid losses.

3. The phaser of claim 1 further comprising:

the valve control unit (32) selectively moving the spool (36) of the control valve (24) with respect to a CTA null position in the Cam Torque Actuated (CTA) mode of operation, where the first chamber (16) and the second chamber (18) are isolated from one another.

4. The phaser of claim 1 further comprising:

the valve control unit (32) selectively moving the spool (36) of the control valve (24) with respect to an advance timing position in the Cam Torque Actuated (CTA) mode of operation, where the first chamber (16) and the second chamber (18) are in fluid communication with one another through the check valve (40) allowing actuating fluid flow from the second chamber (18) to the first chamber (16) in response to cam torque actuation forces and in fluid communication with the actuating fluid supply source (46) to offset fluid losses.

5. The phaser of claim 1 further comprising:

the valve control unit (32) selectively moving the spool (36) of the control valve (24) with respect to a modal null position located between the Cam Torque Actuated (CTA) mode of operation and the Torsional Assist (TA) mode of operation, where cam torque actuation forces have become inadequate to advance the phaser in CTA mode of operation, and where the first chamber (16) is in fluid communication with the actuating fluid supply source (46) to offset losses, and where a CTA recirculation passage (46*a*) is blocked to prevent a direct leak of actuating fluid flow through a branch passage (28*a*) just before an exhaust vent (48c) of the second chamber (18) is opened.

6. The phaser of claim 1 further comprising:

the valve control unit (32) selectively moving the spool (36) of the control valve (24) with respect to an advance timing position in Torsional Assist (TA) mode of operation, where the rotor (20) advances relative to the housing due to a pressure differential on the vane (22), where the first chamber (16) is in fluid communication with the actuating fluid supply source (46) through the check valve (40) allowing actuating fluid flow into the first chamber (16), and the second chamber (18) is in fluid communication through the spool (36) with an exhaust vent passage.

7. The phaser of claim 1 further comprising:

a lock pin (60) moveable between a released position and a locked position to lock the housing (10) and the rotor (20) together independent of actuating fluid flow; and the spool (36) of the control valve (24) selectively connecting the lock pin (60) between an exhaust vent (48*a*, 48*b*) and the actuating fluid supply source (46) to move the lock pin (60) between the locked position and the released position.

8. A variable cam timing phaser for an internal combustion engine having at least one camshaft comprising:

a housing (10) and a rotor (20) connected coaxially with respect to a camshaft to define at least one cavity (10*a*) therebetween and a vane (22) located within each corresponding cavity (10*a*) dividing each corresponding cavity (10*a*) into a first chamber (16) and a second chamber (18);

at least one check valve (40);

a control valve (24) having a longitudinally reciprocal spring biased spool (36) with the at least one check valve (40) located internally within the spool (36), the spool (36) operably moveable between at least one Cam Torque Actuated (CTA) mode of operation, at least one Torsional Assist (TA) mode of operation, and at least one null position, the spool (36) connecting the first chamber (16), the second chamber (18), the at least one check valve (40), and an actuating fluid supply source (46) with respect to one another; and a valve control unit (32) operating the longitudinally reciprocal spool (36) of the control valve (24) in response to an input signal from an engine control unit (34) for movement between the Cam Torque Actuated (CTA) mode of operation, the Torsional Assist (TA) mode of operation, and the at least one null position.

9. The phaser of claim 8 further comprising:

a lock pin (60) moveable between a released position and a locked position to lock the housing (10) and the rotor (20) together independent of actuating fluid flow, where a lock passage (62) associated with the lock pin (60) is in fluid communication with the actuating fluid supply source (46) through the spool (36) to move the lock pin (60) to the released position; and the spool (36) of the control valve (24) operably connecting the lock pin (60) between an exhaust vent (48*a*, 48*b*) and the actuating fluid supply source (46).

10. The phaser of claim 8 further comprising:

the valve control unit (32) selectively moving the spool (36) of the control valve (24) with respect to a retard timing position within a Cam Torque Actuated (CTA) mode of operation, where the first chamber (16) and the second chamber (18) are in fluid communication with one another through the check valve (40) allowing actuating fluid flow from the first chamber (16) to the second chamber (18) in response to cam torque actuation forces and in fluid communication with the actuating fluid supply source (46) to offset fluid losses.

11. The phaser of claim 8 further comprising:

the valve control unit (32) selectively moving the spool (36) of the control valve (24) with respect to a CTA null position within a Cam Torque Actuated (CTA) mode of operation, where the first chamber (16) and the second chamber (18) are isolated from one another.

12. The phaser of claim 8 further comprising:

the valve control unit (32) selectively moving the spool (36) of the control valve (24) with respect to an advance timing position within a Cam Torque Actuated (CTA) mode of operation, where the first chamber (16) and the second chamber (18) are in fluid communication with one another through the check valve (40) allowing actuating fluid flow from the second chamber (18) to the first chamber (16) in response to cam torque actuation forces and in fluid communication with the actuating fluid supply source (46) to offset fluid losses.

13. The phaser of claim 8 further comprising:

the valve control unit (32) selectively moving the spool (36) of the control valve (24) with respect to a modal null position located between the Cam Torque Actuated (CTA) mode of operation and the Torsional Assist (TA) mode of operation, where cam torque actuation forces have become inadequate to advance the phaser in CTA mode of operation, and where the first chamber (16) is in fluid communication with the actuating fluid supply source (46) to offset losses, and where a CTA recirculation passage (46*a*) is blocked to prevent a direct leak of actuating fluid to a passage (28*a*) just before an exhaust vent (48*c*) of the second chamber (18) is opened.

14. The phaser of claim 8 further comprising:

the valve control unit (32) selectively moving the spool (36) of the control valve (24) with respect to an advance timing position within the Torsional Assist (TA) mode of operation, where the rotor (20) advances relative to the housing due to a pressure differential on the vane (22), where the first chamber (16) is in fluid communication with the actuating fluid supply source (46) through the check valve (40) allowing actuating fluid flow into the first chamber (16), the second chamber (18) is in fluid communication through the spool (36) with a vent passage.

15. A variable cam timing phaser for an internal combustion engine having at least one camshaft comprising:

a housing (10) and a rotor (20) connected coaxially with respect to a camshaft and disposed to rotate relative to one another, the housing (10) and the rotor (20) defining therebetween at least one cavity (10*a*) and a vane (22) located within each cavity (10*a*) and dividing each cavity (10*a*) into a first chamber (16) and a second chamber (18);

a lock pin (60) moveable between a released position and a locked position to lock the housing (10) and the rotor (20) together independent of actuating fluid flow;

a control valve (24) having a longitudinally reciprocal spring biased spool (36) with an internally located check valve (40), the spool (36) operably moveable between an advance timing position and a retard timing position within a Cam Torque Actuated (CTA) mode of operation, an advance timing position within a Torsional Assist (TA) mode of operation, and at least one null position, the spool (36) operably connecting the first chamber (16), the second chamber (18), the check valve (40), and an actuating fluid supply source (46) with respect to one another, and operably connecting the lock pin (60) between an exhaust vent (48*a*, 48*b*) and the actuating fluid supply source (46); and a valve control unit having a variable force solenoid (32) operating the longitudinally reciprocal spool (36) of the control valve (24) in response to an input signal from an engine control unit (34) for movement between the Cam Torque Actuated (CTA) modes of operation, the Torsional Assist (TA) mode of operation, and the at least one null position.

* * * * *